US007182339B2

(12) United States Patent
Engarto et al.

(10) Patent No.: US 7,182,339 B2
(45) Date of Patent: Feb. 27, 2007

(54) THICKNESS MEASURING SYSTEM, HAVING IMPROVED SOFTWARE, FOR USE WITHIN A MAIL HANDLING SYSTEM, AND METHOD OF USING SAME

(75) Inventors: Edward S. Engarto, Waverly, NY (US); William A. Arno, Binghamton, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 345 days.

(21) Appl. No.: 10/718,617

(22) Filed: Nov. 24, 2003

(65) Prior Publication Data

US 2004/0113358 A1 Jun. 17, 2004

Related U.S. Application Data

(63) Continuation-in-part of application No. 10/040,761, filed on Jan. 9, 2002, now Pat. No. 6,655,683.

(51) Int. Cl.
*B65H 7/02* (2006.01)
*B07C 1/16* (2006.01)

(52) U.S. Cl. ..... 271/265.04; 271/298; 271/263; 209/584

(58) Field of Classification Search ..... 209/584; 271/298, 262, 263, 265.04; 33/833, 501.02, 33/501.03, 501.04, 784; 702/182, 195
See application file for complete search history.

(56) References Cited

U.S. PATENT DOCUMENTS 3,826,487 A * 7/1974 Forster et al. ..... 271/263
4,121,716 A * 10/1978 Luperti et al. ..... 209/564
4,132,402 A * 1/1979 Morrison et al. ..... 271/263
4,420,747 A * 12/1983 Kistner ..... 340/674
4,426,785 A * 1/1984 Loftus et al. ..... 33/501.04
4,550,252 A * 10/1985 Tee ..... 250/223 R
4,576,287 A * 3/1986 Bingham et al. ..... 209/601
4,700,368 A * 10/1987 Munn et al. ..... 377/8
4,729,556 A * 3/1988 Fujii et al. ..... 271/263
4,753,433 A * 6/1988 Rodi et al. ..... 271/263
4,953,842 A * 9/1990 Tolmie et al. ..... 271/2
4,955,598 A * 9/1990 Hiroshige et al. ..... 271/267
5,011,128 A * 4/1991 Tsuji ..... 271/263
5,029,837 A * 7/1991 Uchiyama ..... 271/110

(Continued)

*Primary Examiner*—Patrick Mackey
*Assistant Examiner*—Jeremy R Severson
(74) *Attorney, Agent, or Firm*—Schwartz & Weinrieb

(57) ABSTRACT

A thickness measuring device for measuring the thickness dimension of an article being conveyed along a conveyor system comprises a rotary encoder, and a lever arm pivotally mounted upon the shaft of the rotary encoder. The lever arm has an end portion thereof disposed in contact with the article conveyor so as to be deflected by an article conveyed along the conveying path. Deflection of the lever arm causes the rotary shaft of the rotary encoder to undergo a predetermined amount of rotation which is indicative of the thickness dimension of the article being conveyed. The system is also operatively associated with a storage bin such that when a plurality of articles, having a predetermined cumulative thickness dimension, are detected, further conveyance of articles to the storage bin is terminated. The system further comprises a central processing unit (CPU) which has incorporated therein improved software which permits the system to accurately determine the thickness dimensions of articles having substantially constant, but relatively large thickness dimensions, as well as articles having variable dimensions.

27 Claims, 2 Drawing Sheets

U.S. PATENT DOCUMENTS 5,075,622 A * 12/1991 Konii et al. ..... 324/229
5,131,648 A * 7/1992 Ito ..... 271/262
5,203,555 A * 4/1993 Cannaverde et al. ..... 271/263
5,222,729 A * 6/1993 Wallaschkowski ..... 271/262
5,238,123 A * 8/1993 Tovini et al. ..... 209/556
5,249,795 A * 10/1993 Nishimoto ..... 271/265.02
5,437,445 A * 8/1995 Chang et al. ..... 271/263
5,577,720 A * 11/1996 Laskowski ..... 271/265.04
5,599,014 A * 2/1997 Kitahara et al. ..... 271/270
5,678,678 A * 10/1997 Brandt et al. ..... 194/206
5,704,246 A * 1/1998 Kruger ..... 73/159
5,712,804 A * 1/1998 Elbling ..... 702/170
5,723,825 A * 3/1998 Dolan et al. ..... 177/145
5,727,692 A * 3/1998 Large et al. ..... 209/603
5,743,521 A * 4/1998 Munakata et al. ..... 271/263
5,823,529 A * 10/1998 Mandel et al. ..... 271/296
6,000,693 A * 12/1999 Tranquilla ..... 271/263
6,079,570 A 6/2000 Oppliger et al. ..... 209/630
6,112,660 A * 9/2000 Junghans et al. ..... 101/350.3
6,123,330 A * 9/2000 Schaal ..... 271/31
6,135,292 A * 10/2000 Pettner ..... 209/603
6,283,304 B1 * 9/2001 Gottlieb et al. ..... 209/603
6,521,854 B2 * 2/2003 Tanimoto ..... 209/586
6,561,509 B2 * 5/2003 Kettenmann et al. ..... 271/263
6,655,683 B2 * 12/2003 Engarto et al. ..... 271/265.04
6,734,417 B2 * 5/2004 Vejtasa ..... 250/231.13
6,749,194 B2 * 6/2004 Hanson et al. ..... 271/176
6,983,934 B1 * 1/2006 Knierim ..... 271/262
7,004,396 B1 * 2/2006 Quine et al. ..... 235/475
2002/0011432 A1 * 1/2002 Tanimoto ..... 209/586
2002/0060421 A1 * 5/2002 Kako et al. ..... 271/259
2002/0113365 A1 * 8/2002 Britton et al. ..... 271/303
2005/0033473 A1 * 2/2005 Weiser et al. ..... 700/227

* cited by examiner

THICKNESS MEASURING SYSTEM, HAVING IMPROVED SOFTWARE, FOR USE WITHIN A MAIL HANDLING SYSTEM, AND METHOD OF USING SAME

CROSS-REFERENCE TO RELATED PATENT APPLICATION

This patent application is a Continuation-in-Part (CIP) of U.S. patent application Ser. No. 10/040,761 which was filed on Jan. 9, 2002 now U.S. Pat. No. 6,655,683 in the name of Edward S. Engarto et al. and which is entitled THICKNESS MEASURING DEVICE FOR USE WITHIN A MAIL HANDLING SYSTEM, AND A METHOD OF USING THE SAME.

FIELD OF THE INVENTION

The present invention relates generally to article thickness measuring apparatus and systems, and more particularly to a new and improved thickness measuring apparatus or system, and a method of using the same, which is particularly useful in connection with the measuring or determining the thickness of individual articles, such as, for example, pieces or units of postal mail, wherein the articles may be any combination of envelopes, letters, catalogs, newspapers, magazines, greeting cards, telephone directories, and the like, such that an automatic mail delivery system, which delivers the mail pieces or units into sorting bins that are adapted to have mail pieces or units stacked therein up to a predetermined height or depth dimension, can stop depositing mail pieces or units into a particular sorting bin when the article thickness measuring apparatus or system determines that the cumulative thickness dimensions of the detected and measured articles equals the predetermined height of the stack of mail pieces or units to be housed and contained within the particular sorting bin.

BACKGROUND OF THE INVENTION

Automatic mail delivery or conveying, sorting, and stacking systems are known which deliver pieces or units of mail, such as, for example, envelopes, letters, catalogs, newspapers, magazines, greeting cards, telephone directories, and the like, into sorting bins that are adapted to have pieces or units of mail stacked therein up to a particular or predetermined height or depth dimension. Since the volumetric amount that a particular sorting bin could hold, contain, or accommodate would obviously comprise a particular number of pieces or units of mail having predetermined thickness dimensions, then it would be desirable for an automatic delivery or conveying, sorting, and stacking system to predetermine the thickness dimension of each individual unit or piece of mail, as well as to track the number of individual mail pieces or units detected or scanned so that a predetermined stack of mail, comprising a predetermined number of pieces or units of mail, can in fact be deposited within a particular sorting bin. PRIOR ART automated mail conveying, sorting, delivering, and stacking systems, however, have exhibited several operational drawbacks or deficiencies along these procedural lines.

For example, in accordance with a first known type of automated mail conveying, sorting, delivering, and stacking system, while such a system is capable of tracking, ascertaining, or determining the number of units or pieces of mail that have been conveyed, sorted, and delivered to predetermined sorting bins, such a system has nevertheless been unable to accurately determine the thickness of each individual piece or unit of mail and to subsequently correlate such information with the total number of detected and counted pieces or units of mail. In particular, the thickness dimension of each individual piece or unit of mail is simply usually estimated in some manner by some means. In accordance with a second type of automated mail delivery or conveying, sorting, and stacking system, the system does not predetermine the thickness dimension of each individual unit or piece of mail, but to the contrary, the system simply determines or senses the height of the entire stack of mail deposited within each individual sorting bin. For example, each sorting bin is provided or equipped with photocell systems which are accordingly activated when the stack of mail deposited within a particular sorting bin reaches or attains a predetermined height or level. This type of system is relatively expensive, however, in view of the fact that each sorting bin must be equipped with its own photocell detection system.

Systems also exist which are capable of determining thickness dimensions of, for example, flat mail pieces or units, however, such systems have not been employed for determining the thickness dimensions of individual pieces or units of mail such that the determined thickness dimensions of the individual mail pieces or units can then be correlated or used in connection with the counted or detected number of individual mail pieces or units so as to correspondingly determine the height of a stack of mail deposited within a particular sorting bin. For example, as disclosed within U.S. Pat. No. 6,123,330, which issued to Schaal on Sep. 26, 2000, a suction separation system is utilized in connection with the conveyance of flat mail pieces, and the system utilizes a rotary potentiometer to determine the thickness dimension of each stack item wherein the thickness dimension is related to, or is a function of, the stack pressure which is suitably monitored, corrected, adjusted, and controlled.

In a similar manner, as disclosed within U.S. Pat. No. 5,727,692, which issued to Large et al. on Mar. 17, 1998, the thickness dimensions of envelopes are determined, however, such thickness dimensions are determined as a means for correspondingly determining whether or not any contents are present within a particular envelope. Still further, as disclosed within U.S. Pat. No. 5,704,246, which issued to Kruger on Jan. 6, 1998, a raster gauge is used to determine the thickness dimensions of objects in order to, in turn, determine whether or not such objects can be subsequently handled by means of other machines or equipment located downstream within the overall processing or handling system. Still yet further, as disclosed within U.S. Pat. No. 5,238,123, which issued to Tovini et al. on Aug. 24, 1993, a system is employed to determine thickness and length dimensions or parameters of envelopes whereby those envelopes which do not have length and thickness dimensions which are within a predetermined range of values are removed from the particularly disclosed handling system. Lastly, as disclosed within U.S. Pat. No. 4,953,842, which issued to Tolmie, Jr. et al. on Sep. 4, 1990, there is disclosed a system for determining the thickness dimensions of mail pieces or units such that the mail pieces or units can be properly conveyed by means of a particular handling system in accordance with a predetermined velocity sequence or profile.

Still further, it has also been experienced that in connection with the conveyance or transportation of different mail pieces or articles, such as, for example, those mail pieces or articles which are characterized by relatively large thickness dimensions, or alternatively, those mail pieces or articles which are characterized by thickness dimensions which vary along the longitudinal extent of the particular mail piece or article, inaccuracies, in connection with the determination of the thickness dimensions of the various mail pieces or articles, can occur. Accordingly, such inaccuracies, in connection with the determination of the thickness dimensions of the various mail pieces or articles, can effectively result in operational malfunctions of the system wherein, for example, the storage bins are not completely filled to their predeterminedly known, designated, or rated capacity. For example, one of the mail pieces or articles that may be conveyed or transported along the conveyor or transportation system may comprise a telephone directory or some similar article having a relatively large but constant thickness dimension. Accordingly, when the thickness dimension detection or determination device does in fact encounter the telephone directory or similar article, the device may experience or undergo repetitive bounce movements with respect to the relatively thick mail piece or article as a result of the sudden encounter of the device with the mail piece or article whose thickness dimension is substantially greater than the average thickness dimension, or the range of thickness dimensions, which may constitute a standard or norm for most of the articles or mail pieces being conveyed or transported by means of the conveyor transportation system. As a result of the thickness detection device experiencing or undergoing the aforenoted repetitive "bounce" movements, wherein the thickness detection device may be displaced from its normal disposition through means of a distance or movement which is greater than the actual thickness dimension of the telephone directory or similar article, false thickness dimension readings will be developed and indicated. Therefore, the true thickness dimensions of such mail pieces or articles will not in fact be able to be accurately determined whereby, in turn, the cumulative thickness dimensions of a multitude of such mail pieces or articles will not in fact be able to be accurately determined in order to properly or completely fill the storage bins.

Continuing still further, similar problems can occur in connection with the accurate determination of the thickness dimensions of those mail pieces or articles which are characterized by thickness dimensions which vary along the longitudinal extent of the particular mail piece or article. Considering, for example, those mail piece packages which may contain greeting cards, or other irregularly shaped articles or objects, wherein the mail piece package is characterized by thickness dimensions which will vary over the longitudinal extent or length of the mail piece package, the thickness detection device will, for example, read, or generate signals indicative of, the varying thickness dimensions, and accordingly, varying thickness dimension readings will be developed and indicated for each mail piece package. Therefore, a single, true or accurate thickness dimension, or at least a substantially accurate average thickness dimension, for each one of such mail piece packages will not in fact be able to be accurately determined whereby, in turn, the cumulative thickness dimensions of a multitude of such mail piece packages will not in fact be able to be accurately determined in order to properly or completely fill the storage bins.

A need therefore exists in the art for a new and improved thickness measuring device, and a method of using the same, for use within a mail handling system wherein the thickness measuring device can determine the thickness dimension of individual pieces or units of mail as the same are conveyed past the device, such that the thickness information or data can be correlated with the number of scanned or detected mail pieces or units which are being delivered to predetermined sorting bins so as to determine the precise number of mail pieces or units that can be deposited within a particular sorting or storage bin such that the stack of mail disposed, housed, or contained within the particular sorting or storage bin has a predetermined height dimension, whereupon further conveyance of mail pieces or units, to such sorting or storage bin, can be terminated until such sorting or storage bin has been emptied or replaced.

In addition, a correlated need exists in the art for a new and improved thickness measuring device, and a method of using the same, for use within a mail handling system wherein the thickness measuring device can accurately determine the thickness dimensions of individual mail pieces, units, or packages, regardless of whether the individual mail pieces, units, or packages are characterized by means of constant, relatively large thickness dimensions, or alternatively, regardless of whether the individual mail pieces, units, or packages are characterized by means of thickness dimensions which will vary along the longitudinal extent or length of the individual mail pieces, units, or packages, such that the thickness information or data can be correlated with the number of scanned or detected mail pieces or units which are being delivered toward predetermined sorting bins so as to determine the precise number of mail pieces or units that can be deposited within a particular one of the sorting or storage bins such that the stack of mail disposed, housed, or contained within the particular sorting or storage bin will have a predetermined height dimension, whereupon further conveyance of mail units or pieces, toward such sorting or storage bin, can be terminated until such sorting or storage bin has been emptied or replaced.

OBJECT OF THE INVENTION

Accordingly, it is the primary object of the present invention to provide a new and improved thickness measuring device and system, and a method of using the same, for determining the thickness dimensions of individual mail pieces, units, or packages, and a mail handling, sorting, and stacking system incorporating the same therein, wherein the new and improved thickness measuring device and system can accurately determine the thickness dimensions of individual mail pieces, units, or packages, regardless of whether the individual mail pieces, units, or packages are characterized by means of constant, relatively large thickness dimensions, or alternatively, whether the individual mail units, pieces, or packages are characterized by means of thickness dimensions which will vary along the longitudinal extent or length of the individual mail pieces, units, or packages, such that the mail handling, sorting, and stacking system can stack an accurately determined amount of mail within a sorting or storage bin so as to completely fill the storage bin, whereupon further deposits of mail within such sorting or storage bin are discontinued.

SUMMARY OF THE INVENTION

The foregoing and other objectives are achieved in accordance with the teachings and principles of the present invention through the provision of a new and improved thickness measuring device, a method of using the same, and a mail handling system in which the thickness measuring device is incorporated, wherein the thickness measuring device comprises a rotary encoder mounted upon a mounting bracket, and wherein further, a movable lever arm is fixedly connected to the rotary shaft of the rotary encoder. A first end of the lever arm has an idler wheel or roller mounted thereon which is adapted to be disposed either in contact with an outer one of a pair of conveyor belts which are provided for conveying mail pieces or units along a conveyor path defined between the pair of conveyor belts, or alternatively, in contact with a single conveyor belt along which the mail pieces or units are conveyed. A hydraulic damper is disposed in contact with the first end of the lever arm, while a second opposite end of the lever arm is fixedly connected to a biasing return spring. As the mail pieces or units respectively encounter the idler wheel or roller of the lever arm, either through means of the outer conveyor belt or directly, each mail piece or unit will cause deflection of the lever arm a predetermined amount, as controlled by means of the hydraulic damper and biasing return spring, in accordance with the thickness dimension of the particular mail piece or unit, and the deflection of the lever arm will accordingly cause rotation of the rotary shaft of the rotary encoder.

Encoder impulse data, corresponding to the rotation of the rotary shaft of the rotary encoder and the deflection amount of the lever arm in accordance with the thickness of the particular piece or unit of mail, will be transmitted to a computer wherein software will effectively convert such impulse data into linear deflection amounts or thickness dimensions or parameters characteristic of the particular unit or piece of mail. The computer software also keeps track of the particular pieces or units of mail, by means of, for example, suitable bar code reader (BCR) or optical character recognition (OCR) apparatus, and correlates the same with the calculated thickness data for each one of the mail pieces or units detected and encountered by means of the rotary encoder lever arm. Stacking storage capacity data for each sorting or storage bin is also pre-entered into the computer, and therefore, the computer can accordingly control the conveyor system such that when a predetermined number of units or pieces of mail having a cumulative thickness dimension, as derived, calculated, or determined by means of the computer from the data supplied thereto from the rotary encoder, has been conveyed to a particular sorting or storage bin which has a predetermined mail piece or unit stacking or storage capacity which equals the cumulative thickness dimension or parameter of the predetermined number of detected or encountered pieces or units of mail, the conveyor will terminate further conveyance of mail to such sorting or storage bin until such sorting or storage bin has either been emptied or replaced by means of a correspondingly sized storage or sorting bin. The system is capable of being utilized in connection with the conveyance of substantially all types of mail including, but not limited to, envelopes, letters, catalogs, newspapers, magazines, greeting cards, telephone directories, and the like.

It is further appreciated that the system of the present invention, and in particular, the computer software thereof, can accurately determine the thickness dimensions of individual mail pieces, units, or packages, regardless of whether the individual mail pieces, units, or packages are characterized by means of constant, relatively large thickness dimensions, such as, for example, telephone directories, or alternatively, regardless of whether the individual mail pieces, units, or packages are characterized by means of thickness dimensions which will vary along the longitudinal extent or length of the individual mail pieces, units, or packages. In connection with those mail pieces, units, or packages which are characterized by means of constant, relatively large thickness dimensions, the computer software will effectively ignore any large deflections characteristic of the "bounces" that the lever arm will undergo as a result of the idler wheel or roller suddenly encountering the relatively large-dimension mail pieces, units, or packages. Instead, the computer software will effectively track the relatively small deflections that the lever arm will undergo and exhibit wherein such relatively small deflections are indicative of the true thickness dimension of the particular mail piece, unit, or package.

In a similar manner, in connection with those mail pieces, units, or packages which are characterized by means of thickness dimensions which vary along the longitudinal extent or length of the individual mail pieces, units, or packages, the computer software will effectively track the variations in the deflections of the lever arm and the idler wheel or roller, in response to the variations in the thickness dimensions of the mail piece, unit, or package, as a function of the longitudinal length or extent of the mail piece, unit, or package. The computer software will then derive or generate an average or mean thickness value from the variable thickness data previously collected as a function of the longitudinal length or extent of the mail piece, unit, or package. In either case, that is, whether the individual mail pieces, units, or packages are characterized by means of constant, relatively large thickness dimensions, or alternatively, whether the individual mail pieces, units, or packages are characterized by means of thickness dimensions which vary along the longitudinal extent or length of the individual mail pieces, units, or packages, the thickness information or data can again be correlated with the number of scanned or detected mail pieces or units which are being delivered toward predetermined sorting bins so as to determine the precise number of mail pieces or units that can be deposited within a particular one of the sorting or storage bins such that the stack of mail disposed, housed, or contained within the particular sorting or storage bin will have a predetermined height dimension, whereupon further conveyance of mail units, pieces, or packages, toward such sorting or storage bin, can be terminated until such sorting or storage bin has been emptied or replaced.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
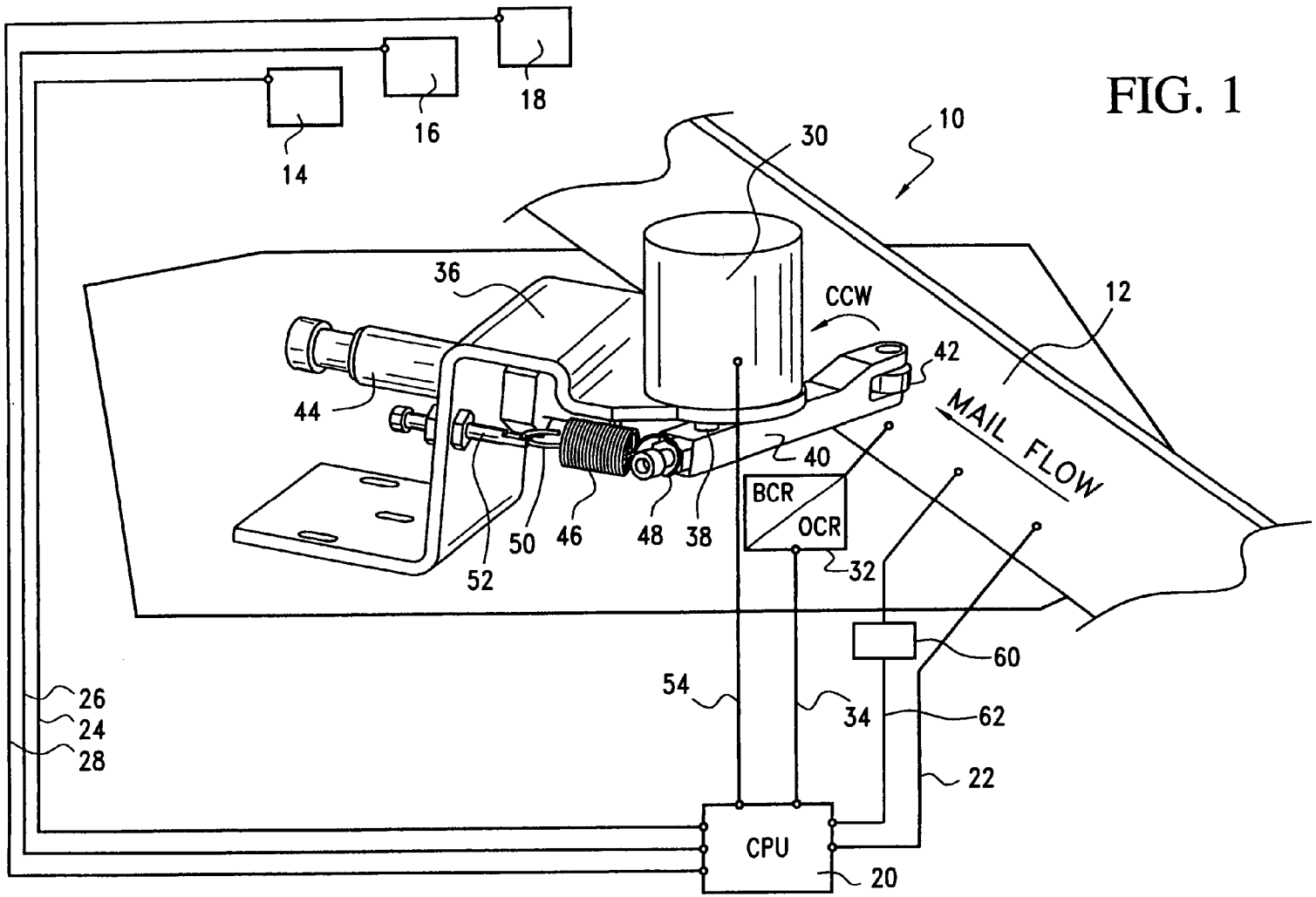
FIG. 1 is a schematic drawing of a new and improved thickness measuring device, as incorporated within an article handling system, for determining the thickness dimensions of individually conveyed articles, such as, for example, various pieces or units of mail, such that a predetermined number of articles, or mail pieces or units, can be deposited within a particular storage or sorting bin having a predeterminedly known storage or stacking capacity.

Referring now to the drawings, and more particularly to FIG. 1 thereof, a new and improved article handling system, having a new and improved thickness measuring device incorporated therein, is disclosed and is generally indicated by the reference character 10. While the article handling system 10 can be adapted for use in connection with the handling or conveyance of substantially different types of articles, for the purposes of the present invention disclosure, the article handling system 10 will be directed toward the handling and conveyance of pieces or units of mail which may, for example, include, but is not necessarily limited to, envelopes, letters, catalogs, newspapers, greeting cards, magazines, telephone directories, and the like. More particularly, it is seen that the new and improved article handling system 10 comprises an article conveyor system as defined by means of a pair of opposed conveyor belts 12 between which articles, such as, for example, various pieces or units of mail, may be conveyed toward a plurality of sorting or storage bins 14,16,18. In accordance with the particularly novel and unique structure or system which has been developed in accordance with the principles and teachings of the present invention, a central processing unit (CPU) 20 is operatively connected to the article conveyor belt drive system 12 by means of signal or communication lines schematically illustrated at 22 in order to not only control the operation of the article conveyor system 12, but in addition, to control various sorting gates, not shown, operatively connected to or comprising the article conveyor system 12 in a well-known manner such that articles being conveyed along article conveyor system 12 may be properly routed to or conducted toward a particular one of the plurality of sorting or storage bins 14,16,18. It is also to be appreciated at this juncture that while the sorting or storage bins 14,16,18 have been illustrated as being "connected" to the central processing unit (CPU) 20 by means of lines 24,26,28, lines 24,26,28 do not actually represent communication or signal lines between the sorting or storage bins 14,16,18 and the central processing unit (CPU) 20, but have been illustrated simply as a means for conveying the idea that the central processing unit (CPU) 20 is aware of the existence of each one of the plurality of sorting or storage bins 14,16,18, as well as the storage capacity characteristic of each one of the plurality of sorting or storage bins 14,16,18, and accordingly correlates such existence, disposition, or location of such sorting or storage bins 14,16, 18, and their respective storage capacities, with the article conveyor system 12 along which the individual articles are being conveyed.

Continuing further, in accordance with the principles and teachings of the present invention, it is to be recalled that the primary objective of the present invention is to predetermine the thickness dimensions or parameters of the articles being conveyed along the article conveyor system 12 such that, knowing the storage capacity of each one of the sorting or storage bins 14,16,18, the central processing unit (CPU) 20 can terminate further conveyance of the articles to a particular one of the plurality of sorting or storage bins 14,16,18 when the storage capacity of that particular one of the sorting or storage bins 14,16,18 has been reached as a result of having had deposited into such particular one of the plurality of sorting or storage bins 14,16,18 a plurality of articles having a cumulative thickness dimension value which is equal to the storage capacity of that particular one of the sorting or storage bins 14,16, 18. Accordingly, in order to determine the thickness dimension of each article as the same is being conveyed along the article conveyor system 12, a rotary encoder 30 is located at a position which is located adjacent to the mail flow path of the article conveyor system 12. A bar code reader-optical character recognition device 32 is also disposed adjacent to the disposition of the rotary encoder 30, and is likewise positioned adjacent to the article conveyor system 12 at a predetermined position upstream of the rotary encoder 30, as considered in the direction of conveyance of the articles along the article conveyor system 12, so as to be capable of detecting each mail piece or article as the same passes by the bar code reader-optical character recognition device 32.

The bar code reader/optical character recognition device 32 is connected to the central processing unit (CPU) 20 by means of a signal or communication line 34, and in this manner, each individual piece or unit of mail conveyed along the article conveyor system 12 is detected and read by means of the bar code reader/optical character recognition device 32. Information identifying each individual mail unit or mail piece conveyed along the article conveyor system 12 can then be transmitted to the central processing unit (CPU) 20 such that the central processing unit (CPU) 20 can effectively track the particular or individual piece or unit of mail. In addition, it is seen that the rotary encoder 30 is mounted upon a suitable Z-shaped mounting bracket 36, and that a rotary shaft 38 of the rotary encoder 30 has a lever arm 40 fixedly mounted upon the lower end portion thereof. The lever arm 40 is juxtaposed with respect to the article conveyor system 12 so as to position an idler wheel or idler roller 42, which is mounted upon one end portion of the lever arm 40, immediately adjacent to the mail flow path of the article conveyor system 12. More particularly, the idler wheel or idler roller 42 is adapted to normally be disposed in contact with the outer one of the oppositely disposed or paired conveyor belts 12 as a result of a piston member, not shown, of, for example, a suitable, single-acting hydraulic damper 44 normally being disposed in contact with the end of the lever arm 40 upon which the idler wheel or roller 42 is mounted. The hydraulic damper 44 is fixedly mounted upon the Z-shaped mounting bracket 36, and the opposite end of the lever arm 40 is operatively connected to a return spring mechanism 46.

As can readily be seen from FIG. 1, a first end portion 48 of the return spring mechanism 46 is connected to the lever arm 40, while a second end portion 50 of the return spring mechanism 46 is connected to a mounting bolt assembly 52 which is fixedly mounted upon an upstanding portion of the Z-shaped mounting bracket 36. Accordingly, when a particular mail piece or unit is conveyed along the article conveyor system 12, the mail piece or unit will cause the outer one of the conveyor belts 12, with which the idler wheel or roller 42 of the lever arm 40 is disposed in contact, to move outwardly and thereby cause counterclockwise deflection of the lever arm 40 against the opposite biases of the return spring 46 and the hydraulic damper 44 as denoted by means of the arrow CCW. Rotation or pivotal movement of the lever arm 40, in turn, will cause a corresponding rotation or pivotal movement of the rotary encoder shaft 38 such that encoder impulses are generated by the rotary encoder 30. It is noted that the use of the single-acting hydraulic damper 44 permits the piston rod member, not shown, thereof to be extended out from the hydraulic damper 44 in a faster operative mode than that characterizing the contraction mode of the piston rod member, not shown, into the hydraulic damper 44. This is important during the pivotal movement of the lever arm 40 in that once a mail piece or article has passed by the idler roller or wheel 42, whereby the lever arm 40 will then tend to return to its normally undeflected position, the piston rod member, not shown, of the hydraulic damper 44 will, under most circumstances, tend to prevent any "bounce-back" of the lever arm 40 and effectively ensure maintenance of the lever arm 40 at its normally undeflected position adjacent to the mail article flow path along conveyor system 12 so as to be in an operative position to detect the next piece or article of mail being conveyed along the conveyor system 12.

As is known in the art, a rotary encoder can generate a predetermined number of impulses per a complete revolution, or in other words, for example, one thousand (1000) impulses per 360° of rotation. Therefore, for a predetermined angular movement of the lever arm 40, and a corresponding angular movement of the rotary encoder shaft 38, a predetermined number of impulses will be generated by the rotary encoder 30. The impulses from the rotary encoder 30 are transmitted to the central processing unit (CPU) 20, by means of a signal or communication line 54, within which software can convert or correlate the angular movement of the lever arm 40, and the corresponding angular movement of the rotary encoder shaft 38, as signified or indicated by the number of impulses generated by the rotary encoder 30, to linear values which are therefore indicative of the thickness dimension of the particular piece or unit of mail just detected or sensed by the lever arm 40 and its operatively associated idler wheel or roller 42.

In view of the fact that such detected or sensed particular piece or unit of mail has also just been immediately previously identified by means of the bar code reader/optical character recognition device 32, and that this mail piece or unit identification information has therefore also been transmitted to the central processing unit (CPU) 20 by means of the signal or communication line 34, the central processing unit (CPU) 20 correlates such information to the effect that a particularly identified unit or piece of mail has a particular thickness dimension. In view of the additional fact that the central processing unit (CPU) 20 not only knows the storage capacity of each one of the storage or sorting bins 14,16,18, but also knows the routing destination of each previously identified and detected or sensed piece or unit of mail, then based upon the cumulative thickness dimensions of a plurality of previously detected or sensed and identified pieces or units of mail which are being routed to a particular destination comprising one of the sorting or storage bins 14,16,18, the central processing unit (CPU) 20 will also know when the storage or stacking capacity of that particular one of the storage or sorting bins 14,16,18 has been or will be reached. The central processing unit (CPU) 20 can therefore terminate any further conveyance of pieces or units of mail to such particular destination storage or sorting bin 14,16, or 18 until such storage or sorting bin 14,16, or 18 has been accordingly emptied or replaced.

It is to be additionally appreciated that while the lever arm 40, and its operatively associated idler wheel or roller 42, have been disclosed within the article handling system 10 as being disposed in contact with an outer surface of an outer one of the conveyor belts 12 for those conveyor systems 12 within which the articles are conveyed between a pair of oppositely disposed conveyor belts 12, substantially the same system comprising lever arm 40, and its operatively associated idler wheel or roller 42, could likewise be employed in connection with those conveyor systems wherein articles are conveyed along, for example, a single conveyor belt, such as, for example, by means of suction or other implements. In connection with such a conveyor system, it is to be appreciated that the idler wheel or roller 42 of the lever arm 40 will normally be disposed in contact with the surface of the conveyor belt along which the articles are being conveyed and will therefore be directly engaged by the conveyed article such that the lever arm 40 will undergo the corresponding aforenoted deflected movement. In either case or instance, the basic operation of the system 10 is substantially the same, that is, deflection of the lever arm 40, as detected by means of the rotary encoder 30, will be indicative of the thickness dimension of the particular unit or piece of mail detected or sensed.

While the new and improved article handling system 10, having the various thickness measuring components integrally incorporated therein as has been disclosed within FIG. 1, is operationally quite successful and accurate in connection with the conveyance of mail pieces or articles which effectively have relatively small and substantially constant thickness dimensions throughout their longitudinal extent or length, such as, for example, conventional letter mail, envelopes, magazines, and the like, it has been experienced that false positive or inaccurate thickness dimension data can sometimes be generated when the particular mail piece or articles being conveyed along the conveyor 12, and the conveyor path defined thereby, comprise mail pieces or articles which have relatively large but substantially constant thickness dimensions throughout their longitudinal extent or length, such as, for example, telephone directories, or alternatively, mail pieces or articles which have variable thickness dimensions throughout their longitudinal extent or length, such as, for example, envelopes or other packages having irregularly shaped articles contained there-within. Therefore, in accordance with further principles and teachings of the present invention, additional software is adapted to be incorporated within the central processing unit (CPU) 20 so as to enable the new and improved article handling system 10 of the present invention, having the various thickness measuring components integrally incorporated therein, to accurately determine the thickness dimensions of all mail pieces or articles, regardless of whether such mail pieces or articles are characterized by means of relatively large but substantially constant thickness dimensions throughout their longitudinal extent or length, or alternatively, regardless of whether such mail pieces or articles are characterized by means of variable thickness dimensions throughout their longitudinal extent or length.

More particularly, with reference still being made to FIG. 1, it is seen that an additional sensor or detector 60, which may comprise, for example, any suitable photodetector or optical detector, is adapted to be disposed adjacent to the article conveyor system 12 at a position either immediately upstream or downstream of the bar code reader/optical character recognition device 32 as considered in the direction of conveyance of the articles along the article conveyor system 12 such that the sensor or detector 60 can effectively operatively cooperate with the bar code reader/optical character recognition device 32 as well as with the article conveyor system 12. In particular, the detector or sensor 60 is utilized to determine the longitudinal extent or length dimension of each individual mail article or piece that passes the sensor 60 by monitoring the presence and absence, that is, the forward edge portion and the rear edge portion, of each individual mail piece or unit. The sensor or detector 60 is adapted to be operatively connected to the central processing unit (CPU) 20 by means of a signal or communication line 62, and in this manner, since each individual mail piece or article conveyed along the article conveyor system 12 is detected, read, and identified by means of the bar code reader/optical character recognition device 32, since timing mechanisms are inherently disposed or contained within the central processing unit (CPU) 20, and since the central processing unit (CPU) 20 always controls and is always cognizant of the conveying speed of the article conveyor system 12, then each individual mail piece or article that is conveyed along the article conveyor system 12 can readily have its longitudinal extent or length determined by means of the central processing unit (CPU) 20.

Continuing further, since the information identifying each individual mail unit or mail piece conveyed along the article conveyor system 12, as well as the information determining its longitudinal extent or length dimension, is transmitted to the central processing unit (CPU) 20, the central processing unit (CPU) 20 can not only now effectively track the particular or individual piece or unit of mail being conveyed along the article conveyor system 12, but in addition, the central processing unit (CPU) 20 will have the longitudinal extent or length dimension, of each individually identified mail piece or article being conveyed along the article conveyor system 12, stored within its memory. Furthermore, since the lever arm 40 will undergo suitable deflection movements, either as a result of its contact engagement with the outer one of the pair of conveyor belts comprising the article conveyor system 12, or as a result of its direct contact with a particular mail piece or article disposed upon a single conveyor belt of the article conveyor system 12, when the particular mail piece or article passes the region at which the idler roller 42 is disposed in contact with the particular one of the noted conveyor belts of the article conveyor system 12, and since the deflection movements of the lever arm 40 are converted into output impulses by means of the rotary encoder 30, wherein such output impulses are transmitted to the central processing unit (CPU) 20 by means of signal line 54, then the software disposed within the central processing unit (CPU) 20 is able to correlate the deflection movements of the lever arm 40 as a function of the longitudinal extent or length dimension of each individually identified mail piece or article as the same are conveyed along the article conveyor system 12.

Accordingly, in connection with those mail pieces or articles which are characterized by relatively large but substantially constant thickness dimensions over the longitudinal extent or length thereof, such as, for example, telephone directories, it is to be appreciated that, despite the presence of the hydraulic damper 44, the sudden operative encounter of the idler roller 42 with the mail piece or article having the relatively large but substantially constant thickness dimension will cause the idler roller 42 and the lever 40 to undergo an initially large deflection movement, as well as a plurality of subsequent deflection movements, due to what is known as "bounce-back" effects. The provision of the hydraulic damper 44 will serve to rapidly dampen such "bounce-back" effects and the relatively large deflection movements, but these relatively large deflection movements of the idler roller 42 and lever arm 40 will cause the rotary encoder 38 to effectively generate impulse signals, indicative of the thickness dimensions of the particular mail piece or article, which are greater than the true thickness dimension of the mail piece or article. In other words, a plurality of false positive or inaccurate thickness dimensions will normally be generated. However, by means of the unique and novel software developed in accordance with the principles and teachings of the present invention, not only can the generation of such plurality of false positive or inaccurate thickness dimensions be effectively prevented, but more particularly, a single thickness dimension, for accurately portraying the true thickness dimension of the mail piece or article which is characterized by means of the relatively large but substantially constant thickness dimension throughout the longitudinal extent or length thereof, can in fact be generated.

Figure 2:
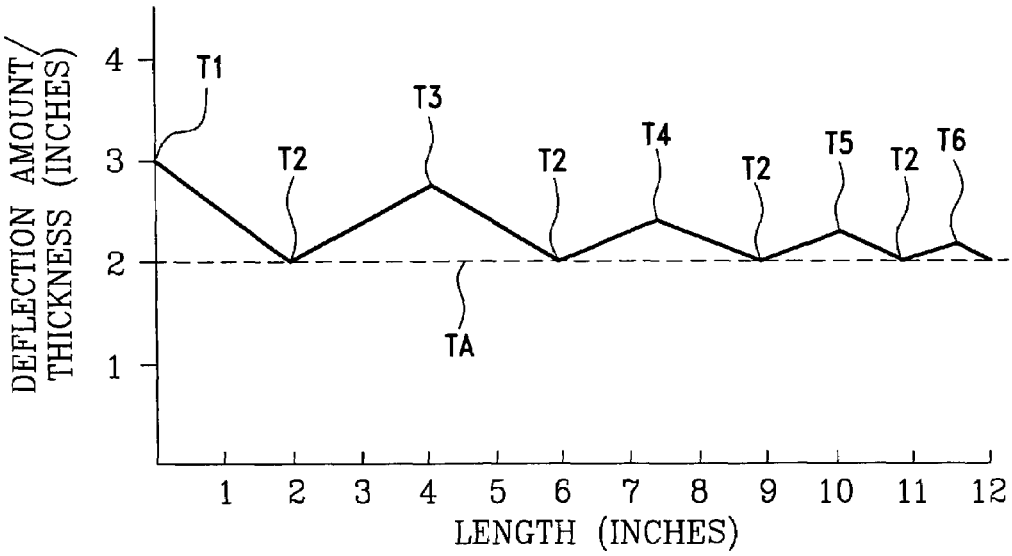
FIG. 2 is a graphical plot schematically illustrating the deflection amounts, experienced by means of the lever arm and recorded by means of the rotary encoder of the new and improved thickness measuring device or system as disclosed within FIG. 1, as a function of the longitudinal extent of the particular mail piece, unit, or package when the particular mail piece, unit, or package is characterized by means of a constant, relatively large thickness dimension and when the lever arm undergoes dampened movements in response to its encounter with the particular mail piece, unit, or package characterized by means of the constant, relatively large thickness dimension.

More particularly, as may best be appreciated from FIG. 2, there is disclosed a graphical plot schematically illustrating the deflection amounts of the lever arm 40, or, in effect, the thickness dimension of the particular mail piece or article, as a function of the longitudinal extent or length dimension of the particular mail piece or article which is characterized by means of the substantially constant, relatively large thickness dimension, as the lever arm 40 undergoes the aforenoted dampened movements in response to its operative encounters with the particular mail piece or article, it being remembered that the deflection amounts of the lever arm 40 correspond with the angular movements of the rotary encoder shaft 38 which are effectively converted by means of the software contained within the central processing unit (CPU) 20 into linear values which are indicative of the thickness dimension of the particular mail piece or article. Accordingly, as the idler roller 42 of the lever arm 40 operatively encounters the particular mail piece or article characterized by means of the substantially constant, relatively large thickness dimension, the lever arm 40 will be forced to undergo an initial deflection or displacement, indicative of a particular thickness dimension of the particular mail piece or article and illustrated at T1, which will be greater than the true thickness of the particular mail piece or article due to the sudden operative impact of the idler roller 42 with the forward end of the particular mail piece or article characterized by means of the substantially constant, relatively large thickness dimension.

Under the influence, for example, of the hydraulic damper 44, the lever arm 40 will tend to return to its normal, undeflected position, however, due to its operative encounter with the external surface of the particular mail piece or article, characterized by means of the substantially constant, relatively large thickness dimension, the lever arm 40 can only effectively return to a deflected or displaced position, indicative of the true thickness dimension of the particular mail piece or article characterized by means of the substantially constant, relatively large thickness dimension, which is illustrated at T2. Continuing further, since the hydraulic damper 44 is not necessarily able to immediately and completely dampen the "bounce-back" effects of the lever arm 40, the lever arm 40 will subsequently experience several additional displacements or "bounce" movements respectively denoted by the graphical positions T3,T4,T5, and T6, it being realized, of course, that the displacements or "bounce" movements become progressively smaller due to the dampening effect of the hydraulic damper 44. In conjunction with such additional displacements or "bounce" movements, it is of course also to be appreciated that after experiencing each one of the noted displacements or "bounce" movements, the lever arm 40 will always return to its deflected or displaced position, indicative of the true thickness dimension of the particular mail piece or article characterized by means of the substantially constant, relatively large thickness dimension, which is illustrated at T2. Accordingly, the software contained within the central processing unit (CPU) 20 is programmed to detect the repetitive, intermittent deflection or displacement values T2, to effectively ignore the abnormally large and inconsistent deflection or displacement values T1,T3,T4,T5,T6, and effectively define a locus TA which is indicative of the true thickness dimension of the particular mail piece or article characterized by means of the substantially constant, relatively large thickness dimension.

Continuing further, it is similarly apparent that in connection with those mail pieces, units, articles, or packages which may be characterized by means of variable thickness dimensions throughout the longitudinal extent or length dimension thereof, software can be specifically programmed into the central processing unit (CPU) 20 so as to enable the system to accurately determine a viable thickness dimension value, for such particular mail piece, unit, article, or package, as best as possible. More particularly, with reference lastly being made to FIG. 3, there is disclosed a graphical plot schematically illustrating the deflection amounts of the lever arm 40, or, in effect, the thickness dimension of the particular mail piece or article, as a function of the longitudinal extent or length dimension of the particular mail piece, unit, article, or package which is characterized by means of the variable thickness dimension, as the lever arm 40 undergoes the aforenoted dampened movements in response to its operative encounters with the particular mail piece, unit, article, or package. Accordingly, as the idler roller 42 of the lever arm 40 operatively encounters the particular mail piece, unit, article, or package characterized by means of the variable thickness dimensions, the lever arm 40 will effectively follow the contours of the mail piece, unit, article, or package, as determined by means of the particular thickness dimensions thereof at the plurality of specific positions along the longitudinal extent thereof, which will of course be indicative of the particular thickness dimension of the particular mail piece, unit, article, or package at the specific positions along the longitudinal extent thereof.

Figure 3:
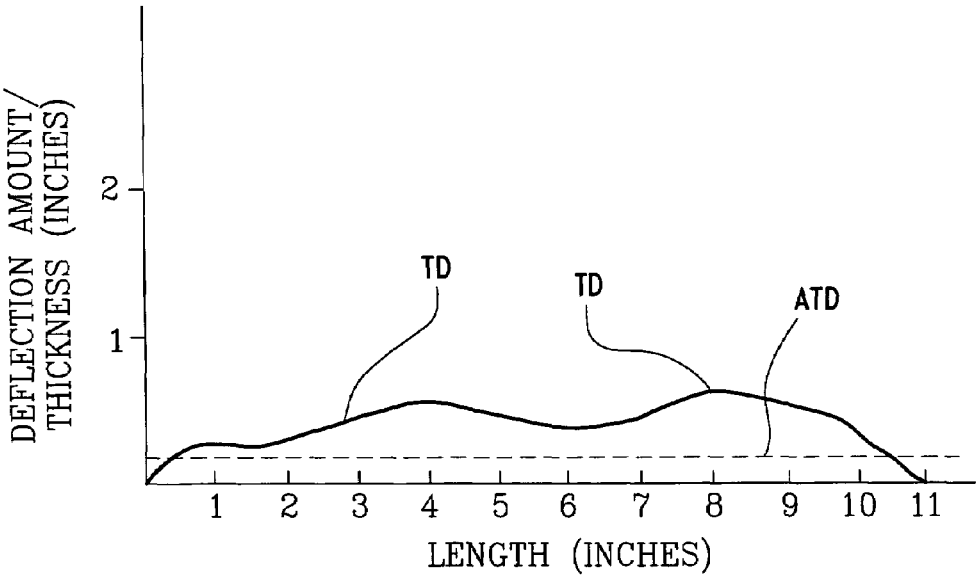
FIG. 3 is a graphical plot, similar to that of FIG. 2, schematically illustrating the deflection amounts, experienced by means of the lever arm and recorded by means of the rotary encoder, of the new and improved thickness measuring device or system, as disclosed within FIG. 1, as a function of the longitudinal extent of the particular mail piece, unit, or package when the particular mail piece, unit, or package is characterized by means of variable thickness dimensions and when the lever arm undergoes variable deflective movements in response to its traversal with respect to the particular mail piece, unit, or package characterized by means of the variable thickness dimensions.

These thickness dimensions or values of the particular mail piece, unit, article, or package will of course be continually entered into the memory of the central processing unit (CPU) 20 whereby the graphical plot of FIG. 3, illustrating the various thickness dimensions TD as a function of the longitudinal extent or length of the particular mail piece, unit, article, or package, can accordingly be derived. Consequently, in accordance with the particular program incorporated within the software of the central processing unit (CPU) 20, the central processing unit (CPU) can subsequently, in turn, generate or determine a viable thickness dimension which will effectively be an average thickness dimension value ATD. This average thickness dimension value ATD will then be utilized within the central processing unit (CPU) 20 to designate the thickness dimension value of the particular mail piece, unit, article, or package, and such average thickness dimension value ATD of the particular mail piece, unit, article, or package can be utilized in conjunction with the other thickness dimension values of the other mail pieces or units whereby the cumulative thickness dimensions of the plurality of mail pieces or units can be correlated with the storage capacity of any one of the particular storage or sorting bins 14,16,18.

Thus, it may be seen that in accordance with the principles and teachings of the present invention, a new and improved article handling system, having a new and improved thickness measuring device incorporated therein, has been developed whereby thickness dimensions of conveyed articles, such as, for example, pieces or units of mail, can be readily determined, even regardless of whether the mail pieces or articles have relatively large but substantially constant thickness dimensions throughout their longitudinal extent or length, such as, for example, telephone directories, or alternatively, mail pieces or articles which have variable thickness dimensions throughout their longitudinal extent or length, such as, for example, envelopes or other packages having irregularly shaped articles contained therewithin. In addition, such determined thickness dimensions can be correlated with particular article identification information or data such that the cumulative or total thickness value of a plurality of conveyed articles can be readily determined. This information can, in turn, be utilized in connection with the conveyance of a plurality of articles toward destination storage or sorting bins within which articles are to be stacked to a predetermined height or level. When the system determines that the predetermined height or level within a particular storage or sorting bin has been or will be reached, further conveyance of articles by the article handling system and toward such storage or sorting bin is terminated and is not resumed until the particular sorting or storage bin has been emptied or replaced by means of a new sorting or storage bin.

It is to be noted that many variations and modifications of the present invention are possible in light of the above teachings. It is therefore to be understood that within the scope of the appended claims, the present invention may be practiced otherwise than as has been specifically described herein.

What is claimed as new and desired to be protected by Letters Patent of the United States of America, is:

1. A system for measuring the thickness dimension of an article being conveyed along a predetermined conveyor path, wherein the article has a thickness dimension and a length dimension, comprising:

an article conveyor for conveying a plurality of articles along a predetermined conveyor path, wherein each one of the conveyed articles has a thickness dimension and a length dimension;

a mounting bracket;

a rotary encoder mounted upon said mounting bracket and comprising a rotary shaft;

a lever arm movably mounted upon said rotary shaft of said rotary encoder and having a first end portion thereof disposed in contact with said article conveyor so as to operatively engage each one of the articles being conveyed along said predetermined conveyor path by said article conveyor, whereupon said first end portion of said lever arm encounters an article, which is being conveyed along said predetermined conveyor path by said article conveyor and which has a sufficiently large thickness dimension to cause said lever arm to undergo bounce deflections, said lever arm will repetitively move away from and back toward said article conveyor, as the article is conveyed along said predetermined conveyor path by said article conveyor, between first positions which are indicative of first false positive thickness dimensions of the article being conveyed along said predetermined conveyor path by said article conveyor, and a second position which is indicative of a second true thickness dimension of the article being conveyed along said predetermined conveyor path by said article conveyor, as determined by corresponding rotations of said rotary shaft of said rotary encoder wherein said rotary encoder will emit correlated thickness dimension data as a function of the length of the article being conveyed along said predetermined conveyor path by said article conveyor; and means for determining the second true thickness dimension of the article being conveyed along said predetermined conveyor path by said article conveyor by effectively eliminating the first false positive thickness dimensions of the article being conveyed along said predetermined conveyor path by said article conveyor.

2. The system as set forth in claim 1, wherein said means for determining the true thickness dimension of the article being conveyed along said predetermined conveyor path by said article conveyor, comprises:

sensor means for predetermining the length dimension of each article being conveyed along said predetermined conveyor path by said article conveyor; and central processing means (CPU), operatively connected to said rotary encoder, for determining the first and second thickness dimensions of each article being conveyed along said predetermined conveyor path by said article conveyor as a function of the predetermined length dimension of each article being conveyed along said predetermined conveyor path by said article conveyor.

3. The system as set forth in claim 2, wherein:

said central processing unit (CPU) comprises program means for detecting repetitive substantially similar second thickness dimension values and which can ignore variable first thickness dimension values.

4. The system as set forth in claim 3, wherein:

said program means of said central processing unit (CPU) can determine a locus, from said repetitive substantially similar second thickness dimension values, which is indicative of the second true thickness dimension of the article being conveyed along said predetermined conveyor path by said article conveyor.

5. The system as set forth in claim 1, wherein:

said first positions, to which said lever arm is moved so as to indicate the first false positive thickness dimensions of the article being conveyed along said predetermined conveyor path by said article conveyor, are located more remote from said article conveyor than said second position to which said lever arm is moved so as to indicate the second true thickness dimension of the article being conveyed along said predetermined conveyor path by said article conveyor.

6. A conveyor system for depositing a predetermined number of articles, having a predetermined cumulative thickness dimension, into a storage bin having a predetermined storage capacity, comprising:

a storage bin having a predetermined storage capacity for accommodating therein a predetermined number of articles having a predetermined cumulative thickness dimension such that the predetermined number of articles can be stored within said storage bin;

an article conveyor for conveying a plurality of articles along a predetermined conveyor path toward said storage bin, wherein each one of the conveyed articles has a thickness dimension and a length dimension;

a mounting bracket;

a rotary encoder mounted upon said mounting bracket and comprising a rotary shaft;

a lever arm movably mounted upon said rotary shaft of said rotary encoder and having a first end portion thereof disposed in contact with said article conveyor so as to operatively engage each one of the articles being conveyed along said predetermined conveyor path by said article conveyor, whereupon said first end portion of said lever arm encountering an article, which is being conveyed along said predetermined conveyor path by said article conveyor and which has a sufficiently large thickness dimension to cause said lever arm to undergo bounce deflections, said lever arm will repetitively move away from and back toward said article conveyor, as the article is conveyed along said predetermined conveyor path by said article conveyor, between first positions which are indicative of first false positive thickness dimensions of the article being conveyed along said predetermined conveyor path by said article conveyor, and a second position which is indicative of a second true thickness dimension of the article being conveyed along said predetermined conveyor path by said article conveyor, as determined by corresponding rotations of said rotary shaft of said rotary encoder wherein said rotary encoder will emit correlated thickness dimension data as a function of the length of the article being conveyed along said predetermined conveyor path by said article conveyor;

means for determining the second true thickness dimension of the article being conveyed along said predetermined conveyor path by said article conveyor by effectively eliminating the first false positive thickness dimensions of the article being conveyed along said predetermined conveyor path by said article conveyor; and means operatively connected to said article conveyor for correlating said second true thickness dimension data of each article being conveyed along said predetermined conveyor path by said article conveyor with said predetermined storage capacity of said storage bin such that when the cumulative second true thickness dimension of a plurality of articles being conveyed along said predetermined conveyor path by said article conveyor, as indicated by said thickness dimension data emitted by said rotary encoder, comprises a predetermined value with respect to said storage capacity of said storage bin, operation of said article conveyor will be terminated so as not to deposit any additional articles into said storage bin.

7. The system as set forth in claim 6, wherein:

said means operatively connected to said article conveyor comprises a central processing unit (CPU).

8. The system as set forth in claim 7, further comprising:

reader means for reading indicia upon each one of the articles being conveyed along said predetermined conveyor path by said article conveyor and for transmitting said read indicia to said central processing unit (CPU) such that said central processing unit (CPU) is enabled to track each individual article being conveyed along said predetermined conveyor path by said article conveyor.

9. The system as set forth in claim 8, wherein:

said central processing unit (CPU) has stored therein said predetermined storage capacity of said storage bin so as to be able to correlate said storage capacity of said storage bin with the cumulative thickness dimension data of the plurality of articles being conveyed along said predetermined conveyor path by said article conveyor.

10. The system as set forth in claim 8, wherein:

said reader means comprises a reader selected from the group comprising a bar code reader and an optical character recognition reader.

11. A system for measuring the thickness dimension of an article being conveyed along a predetermined conveyor path, wherein the article has a variable thickness dimension along its longitudinal extent defining a predetermined length dimension, comprising:

an article conveyor for conveying a plurality of articles along a predetermined conveyor path, wherein each one of the conveyed articles has a variable thickness dimension along its longitudinal extent defining a predetermined length dimension;

a mounting bracket;

a rotary encoder mounted upon said mounting bracket and comprising a rotary shaft;

a lever arm movably mounted upon said rotary shaft of said rotary encoder and having a first end portion thereof disposed in contact with said article conveyor so as to operatively engage each one of the articles being conveyed along said predetermined conveyor path by said article conveyor, whereupon said first end portion of said lever arm encountering an article, which is being conveyed along said predetermined conveyor path by said article conveyor and which has a variable thickness dimension along its longitudinal extent defining a predetermined length dimension, said lever arm will move in a variable manner with respect to said article conveyor, as the article is conveyed along said predetermined conveyor path by said article conveyor, between a plurality of different positions which are indicative of a plurality of different thickness dimensions of the article being conveyed along said predetermined conveyor path by said article conveyor, as determined by corresponding rotations of said rotary shaft of said rotary encoder wherein said rotary encoder will emit correlated thickness dimension data as a function of the length of the article being conveyed along said predetermined conveyor path by said article conveyor; and means for determining an average thickness dimension of the article being conveyed along said predetermined conveyor path by said article conveyor from said plurality of different thickness dimensions as generated from said thickness dimension data by said rotary encoder.

12. The system as set forth in claim 11, wherein said means for determining the average thickness dimension of the article being conveyed along said predetermined conveyor path by said article conveyor, comprises:

sensor means for predetermining the length dimension of each article being conveyed along said predetermined conveyor path by said article conveyor; and central processing means (CPU), operatively connected to said rotary encoder, for determining the plurality of thickness dimensions of each article being conveyed along said predetermined conveyor path by said article conveyor as a function of the predetermined length dimension of each article being conveyed along said predetermined conveyor path by said article conveyor.

13. The system as set forth in claim 12, wherein:

said central processing unit (CPU) comprises program means for detecting said plurality of different thickness dimension values and for averaging said plurality of different thickness dimension values.

14. The system as set forth in claim 13, wherein:

said program means of said central processing unit (CPU) can determine a locus, from said plurality of different thickness dimension values, which is indicative of the average thickness dimension of the article being conveyed along said predetermined conveyor path by said article conveyor.

15. A conveyor system for depositing a predetermined number of articles, having a predetermined cumulative thickness dimension, into a storage bin having a predetermined storage capacity, comprising:

a storage bin having a predetermined storage capacity for accommodating therein a predetermined number of articles having a predetermined cumulative thickness dimension such that the predetermined number of articles can be stored within said storage bin;

an article conveyor for conveying a plurality of articles along a predetermined conveyor path toward said storage bin, wherein each one of the conveyed articles has a variable thickness dimension along its longitudinal extent defining a predetermined length dimension;

a mounting bracket;

a rotary encoder mounted upon said mounting bracket and comprising a rotary shaft;

a lever arm movably mounted upon said rotary shaft of said rotary encoder and having a first end portion thereof disposed in contact with said article conveyor so as to operatively engage each one of the articles being conveyed along said predetermined conveyor path by said article conveyor, whereupon said first end portion of said lever arm encountering an article, which is being conveyed along said predetermined conveyor path by said article conveyor and which has a variable thickness dimension along its longitudinal extent defining a predetermined length dimension, said lever arm will move in a variable manner with respect to said article conveyor, as the article is conveyed along said predetermined conveyor path by said article conveyor, between a plurality of different positions which are indicative of a plurality of different thickness dimensions of the article being conveyed along said predetermined conveyor path by said article conveyor, as determined by corresponding rotations of said rotary shaft of said rotary encoder wherein said rotary encoder will emit correlated thickness dimension data as a function of the length of the article being conveyed along said predetermined conveyor path by said article conveyor;

means for determining an average thickness dimension of the article being conveyed along said predetermined conveyor path by said article conveyor from said plurality of different thickness dimensions as generated from said thickness dimension data by said rotary encoder; and means operatively connected to said article conveyor for correlating said average thickness dimension data of each article being conveyed along said predetermined conveyor path by said article conveyor with said predetermined storage capacity of said storage bin such that when the cumulative average thickness dimension of the plurality of articles being conveyed along said predetermined conveyor path by said article conveyor, as indicated by said thickness dimension data emitted by said rotary encoder, comprises a predetermined value with respect to said storage capacity of said storage bin, operation of said article conveyor will be terminated so as not to deposit any additional articles into said storage bin.

16. The system as set forth in claim 15, wherein:

said means operatively connected to said article conveyor comprises a central processing unit (CPU).

17. The system as set forth in claim 16, further comprising:

reader means for reading indicia upon each one of the articles being conveyed along said predetermined conveyor path by said article conveyor and for transmitting said read indicia to said central processing unit (CPU) such that said central processing unit (CPU) is enabled to track each individual article being conveyed along said predetermined conveyor path by said article conveyor.

18. The system as set forth in claim 17, wherein:

said central processing unit (CPU) has stored therein said predetermined storage capacity of said storage bin so as to be able to correlate said storage capacity of said storage bin with the cumulative thickness dimension data of the plurality of articles being conveyed along said predetermined conveyor path by said article conveyor.

19. The system as set forth in claim 17, wherein:

said reader means comprises a reader selected from the group comprising a bar code reader and an optical character recognition reader.

20. A method for depositing a predetermined number of articles, having a predetermined cumulative thickness dimension, into a storage bin having a predetermined storage capacity, comprising the steps of:

providing a storage bin having a predetermined storage capacity for accommodating therein a predetermined number of articles having a predetermined cumulative thickness dimension such that the predetermined number of articles can be stored within said storage bin;

providing an article conveyor for conveying a plurality of articles along a predetermined conveyor path toward said storage bin, wherein each one of the conveyed articles has a thickness dimension and a length dimension;

positioning a rotary encoder, having a rotary shaft, adjacent to said article conveyor;

movably mounting a lever arm upon said rotary shaft of said rotary encoder wherein a first end portion of said lever arm is disposed in contact with said article conveyor so as to operatively engage each one of the articles being conveyed along said predetermined conveyor path by said article conveyor, whereupon said first end portion of said lever arm encounters an article, which is being conveyed along said predetermined conveyor path by said article conveyor and which has a sufficiently large thickness dimension to cause said lever arm to undergo bounce deflections, said lever arm will repetitively move away from and back toward said article conveyor, as the article is conveyed along said predetermined conveyor path by said article conveyor, between first positions which are indicative of first false positive thickness dimensions of the article being conveyed along said predetermined conveyor path by said article conveyor, and a second position which is indicative of a second true thickness dimension of the article being conveyed along said predetermined conveyor path by said article conveyor, as determined by corresponding rotations of said rotary shaft of said rotary encoder wherein said rotary encoder will emit correlated thickness dimension data as a function of the length of the article being conveyed along said predetermined conveyor path by said article conveyor;

determining the second true thickness dimension of each article being conveyed along said predetermined conveyor path by said article conveyor by effectively eliminating the first false positive thickness dimensions of each article being conveyed along said predetermined conveyor path by said article conveyor;

correlating said second true thickness dimension data of each article being conveyed along said predetermined conveyor path by said article conveyor with said predetermined storage capacity of said storage bin; and controlling the operation of said article conveyor in such a manner that when the cumulative thickness dimension of a plurality of articles being conveyed along said predetermined conveyor path of said article conveyor, as indicated by said thickness dimension data emitted by said rotary encoder and comprising said second true thickness dimensions, comprises a predetermined value with respect to said storage capacity of said storage bin, operation of said article conveyor will be terminated so as not to deposit any additional articles into said storage bin.

21. The method as set forth in claim 20, wherein:

said steps of determining the second true thickness dimension of each article being conveyed along said predetermined conveyor path by said article conveyor, correlating said second true thickness dimension data with said storage capacity of said storage bin, and controlling the operation of said article conveyor, are performed by a central processing unit (CPU).

22. The method as set forth in claim 21, further comprising the steps of:

reading indicia upon each one of the articles being conveyed along said predetermined conveyor path by said article conveyor; and transmitting said read indicia to said central processing unit (CPU) such that said central processing unit (CPU) is enabled to track each individual article being conveyed along said predetermined conveyor path by said article conveyor.

23. The method as set forth in claim 22, wherein:

said step of correlating said storage capacity of said storage bin with the cumulative thickness dimension data of the plurality of articles being conveyed along said predetermined conveyor path by said article conveyor comprises the step of storing said predetermined storage capacity of said storage bin within said central processing unit (CPU).

24. A method for depositing a predetermined number of articles, having a predetermined cumulative thickness dimension, into a storage bin having a predetermined storage capacity, comprising:

providing a storage bin having a predetermined storage capacity for accommodating therein a predetermined number of articles having a predetermined cumulative thickness dimension such that the predetermined number of articles can be stored within said storage bin;

providing an article conveyor for conveying a plurality of articles along a predetermined conveyor path toward said storage bin, wherein each one of the conveyed articles has a variable thickness dimension along its longitudinal extent defining a predetermined length dimension;

positioning a rotary encoder, having a rotary shaft, adjacent to said article conveyor;

movably mounting a lever arm upon said rotary shaft of said rotary encoder wherein a first end portion of said lever arm is disposed in contact with said article conveyor so as to operatively engage each one of the articles being conveyed along said predetermined conveyor path by said article conveyor, whereupon said first end portion of said lever arm encountering an article, which is being conveyed along said predetermined conveyor path by said article conveyor and which has a variable thickness dimension along its longitudinal extent defining a predetermined length dimension, said lever arm will move in a variable manner with respect to said article conveyor, as the article is conveyed along said predetermined conveyor path by said article conveyor, between a plurality of different positions which are indicative of a plurality of different thickness dimensions of the article being conveyed along said predetermined conveyor path by said article conveyor, as determined by corresponding rotations of said rotary shaft of said rotary encoder wherein said rotary encoder will emit correlated thickness dimension data as a function of the length of the article being conveyed along said predetermined conveyor path by said article conveyor;

providing means for determining the average thickness dimension of each article being conveyed along said predetermined conveyor path by said article conveyor from said plurality of different thickness dimensions as generated from said thickness dimension data by said rotary encoder;

providing means for correlating said average thickness dimension data of each article being conveyed along said predetermined conveyor path by said article conveyor with said predetermined storage capacity of said storage bin; and controlling the operation of said article conveyor in such a manner that when the cumulative thickness dimension of a plurality of articles being conveyed along said predetermined conveyor path of said article conveyor, as indicated by said thickness dimension data emitted by said rotary encoder and comprising said average thickness dimensions, comprises a predetermined value with respect to said storage capacity of said storage bin, operation of said article conveyor will be terminated so as not to deposit any additional articles into said storage bin.

25. The method as set forth in claim 24, wherein:

said steps of determining the average thickness dimension of each article being conveyed along said predetermined conveyor path by said article conveyor, correlating said average thickness dimension data with said storage capacity of said storage bin, and controlling the operation of said article conveyor, are performed by a central processing unit (CPU).

26. The method as set forth in claim 25, further comprising the step of:

providing reader means for reading indicia upon each one of the articles being conveyed along said predetermined conveyor path by said article conveyor and for transmitting said read indicia to said central processing unit (CPU) such that said central processing unit (CPU) is enabled to track each individual article being conveyed along said predetermined conveyor path by said article conveyor.

27. The method as set forth in claim 26, wherein:

said step of correlating said storage capacity of said storage bin with the cumulative thickness dimension data of the plurality of articles being conveyed along said predetermined conveyor path by said article conveyor comprises the step of storing said predetermined storage capacity of said storage bin within said central processing unit (CPU).

* * * * *